US006281458B1

(12) United States Patent
Castonguay et al.

(10) Patent No.: US 6,281,458 B1
(45) Date of Patent: Aug. 28, 2001

(54) CIRCUIT BREAKER AUXILIARY MAGNETIC TRIP UNIT WITH PRESSURE SENSITIVE RELEASE

(75) Inventors: Roger N. Castonguay, Terryville; Dave Christensen, Harwinton; Randy Greenberg, Granby, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/512,979

(22) Filed: Feb. 24, 2000

(51) Int. Cl.[7] ..... H01H 9/44
(52) U.S. Cl. ..... 218/22; 335/16; 219/157
(58) Field of Search ..... 335/16, 147, 195, 335/167–176; 218/23–28, 22, 154–158

(56) References Cited

U.S. PATENT DOCUMENTS

| | | | |
|---|---|---|---|
| D. 367,265 | | 2/1996 | Yamagata et al. . |
| 2,340,682 | | 2/1944 | Powell . |
| 2,719,203 | | 9/1955 | Getzheiser et al. . |
| 2,937,254 | | 5/1960 | Ericson . |
| 3,158,717 | | 11/1964 | Jeneks et al. . |
| 3,162,739 | | 12/1964 | Klein et al. . |
| 3,197,582 | | 7/1965 | Norden . |
| 3,307,002 | | 2/1967 | Cooper . |
| 3,517,356 | | 6/1970 | Hanarusa . |
| 3,631,369 | * | 12/1971 | Menocal ..... 218/22 |
| 3,803,455 | | 4/1974 | Willard . |
| 3,883,781 | | 5/1975 | Cotton . |
| 4,129,762 | | 12/1978 | Bruchet . |
| 4,144,513 | | 3/1979 | Shafer et al. . |
| 4,158,119 | | 6/1979 | Krakik . |
| 4,165,453 | | 8/1979 | Hennemann . |
| 4,166,988 | | 9/1979 | Ciarcia et al. . |
| 4,220,934 | | 9/1980 | Wafer et al. . |
| 4,255,732 | | 3/1981 | Wafer et al. . |
| 4,259,651 | | 3/1981 | Yamat . |
| 4,263,492 | | 4/1981 | Maier et al. . |

(List continued on next page.)

FOREIGN PATENT DOCUMENTS

| | | |
|---|---|---|
| 819 008 A | 12/1974 | (BE) . |
| 12 27 978 | 11/1966 | (DE) . |
| 30 47 360 | 6/1982 | (DE) . |
| 0 061 092 | 9/1982 | (DE) . |
| 38 02 184 | 8/1989 | (DE) . |
| 38 43 277 | 6/1990 | (DE) . |
| 44 19 240 | 1/1995 | (DE) . |
| 0 342 133 | 11/1959 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

An auxiliary magnetic trip unit for a circuit breaker arranged on the load strap of an industrial-rated circuit breaker to interrupt circuit current upon occurrence of a high-level short circuit fault. The magnetic trip unit employs a magnet yoke, an armature, a trip lever for interacting with a latching mechanism of a circuit breaker operating mechanism, and a lever arranged to restrain the armature from moving toward the magnet yoke and to release the armature in response to a predetermined level of pressurized gas. Thus providing an auxiliary magnetic trip unit for use with circuit breakers for selective short circuit overcurrent protection in an electrical distribution system with circuit breakers connected in series.

12 Claims, 5 Drawing Sheets

U.S. PATENT DOCUMENTS 4,276,527 6/1981 Gerbert-Gaillard et al. .
4,297,663 10/1981 Seymour et al. .
4,301,342 11/1981 Castonguay et al. .
4,360,852 11/1982 Gilmore .
4,368,444 1/1983 Preuss et al. .
4,375,021 2/1983 Pardini et al. .
4,375,022 2/1983 Daussin et al. .
4,376,270 3/1983 Staffen .
4,383,146 5/1983 Bur .
4,392,036 7/1983 Troebel et al. .
4,393,283 7/1983 Masuda .
4,401,872 8/1983 Boichot-Castagne et al. .
4,409,573 10/1983 DiMarco et al. .
4,435,690 3/1984 Link et al. .
4,467,297 8/1984 Boichot-Castagne et al. .
4,468,645 8/1984 Gerbert-Gaillard et al. .
4,470,027 9/1984 Link et al. .
4,479,143 10/1984 Watanabe et al. .
4,488,133 12/1984 McClellan et al. .
4,492,941 1/1985 Nagel .
4,541,032 9/1985 Schwab .
4,546,224 10/1985 Mostosi .
4,550,360 10/1985 Dougherty .
4,562,419 12/1985 Preuss et al. .
4,589,052 5/1986 Dougherty .
4,595,812 6/1986 Tamaru et al. .
4,611,187 9/1986 Banfi .
4,612,430 9/1986 Sloan et al. .
4,616,198 10/1986 Pardini .
4,622,444 11/1986 Kandatsu et al. .
4,631,625 12/1986 Alexander et al. .
4,642,431 2/1987 Tedesco et al. .
4,644,438 2/1987 Puccinelli et al. .
4,649,247 3/1987 Preuss et al. .
4,658,322 4/1987 Rivera .
4,672,501 6/1987 Bilac et al. .
4,675,481 6/1987 Markowski et al. .
4,682,264 7/1987 Demeyer .
4,689,712 8/1987 Demeyer .
4,694,373 9/1987 Demeyer .
4,710,845 12/1987 Demeyer .
4,717,985 1/1988 Demeyer .
4,733,211 3/1988 Castonguay et al. .
4,733,321 3/1988 Lindeperg .
4,764,650 8/1988 Bur et al. .
4,768,007 8/1988 Mertz et al. .
4,780,786 10/1988 Weynachter et al. .
4,831,221 5/1989 Yu et al. .
4,870,531 9/1989 Danek .
4,883,931 11/1989 Batteux et al. .
4,884,047 11/1989 Baginski et al. .
4,884,164 11/1989 Dziura et al. .
4,900,882 2/1990 Bernard et al. .
4,910,485 3/1990 Bolongeat-Mobleu et al. .
4,914,541 4/1990 Tripodi et al. .
4,916,420 4/1990 Bartolo et al. .
4,916,421 4/1990 Pardini et al. .
4,926,282 5/1990 McGhie .
4,935,590 6/1990 Malkin et al. .
4,937,706 6/1990 Schueller et al. .
4,939,492 7/1990 Raso et al. .
4,943,691 7/1990 Mertz et al. .
4,943,888 7/1990 Jacob et al. .
4,950,855 8/1990 Bolonegeat-Mobleu et al. .
4,951,019 8/1990 Gula .
4,952,897 8/1990 Barnel et al. .
4,958,135 9/1990 Baginski et al. .
4,965,543 10/1990 Batteux .
4,983,788 1/1991 Pardini .
5,001,313 3/1991 Leelerq et al. .
5,004,878 4/1991 Seymour et al. .
5,029,301 7/1991 Nebon et al. .
5,030,804 7/1991 Abri .
5,057,655 10/1991 Kersusan et al. .
5,077,627 12/1991 Fraisse .
5,083,081 1/1992 Barrault et al. .
5,095,183 3/1992 Raphard et al. .
5,103,198 4/1992 Morel et al. .
5,115,371 5/1992 Tripodi .
5,120,921 6/1992 DiMarco et al. .
5,121,092 * 6/1992 Castonguay et al. ..... 335/172
5,132,865 7/1992 Mertz et al. .
5,138,121 8/1992 Streich et al. .
5,140,115 8/1992 Morris .
5,153,802 10/1992 Mertz et al. .
5,155,315 10/1992 Malkin et al. .
5,166,483 11/1992 Kersusan et al. .
5,172,087 12/1992 Castonguay et al. .
5,178,504 1/1993 Falchi .
5,184,717 2/1993 Chou et al. .
5,187,339 2/1993 Lissandrin .
5,198,956 3/1993 Dvorak .
5,200,724 4/1993 Gula et al. .
5,210,385 5/1993 Morel et al. .
5,239,150 8/1993 Bolongeat-Mobleu et al. .
5,260,533 11/1993 Livesey et al. .
5,262,744 11/1993 Arnold et al. .
5,280,144 1/1994 Bolongeat-Mobleu et al. .
5,281,776 1/1994 Morel et al. .
5,296,660 3/1994 Morel et al. .
5,296,664 3/1994 Crookston et al. .
5,298,874 3/1994 Morel et al. .
5,300,907 4/1994 Nereau et al. .
5,310,971 5/1994 Vial et al. .
5,313,180 5/1994 Vial et al. .
5,317,471 5/1994 Izoard et al. .
5,331,500 7/1994 Corcoles et al. .
5,334,808 8/1994 Bur et al. .
5,341,191 8/1994 Crookston et al. .
5,347,096 9/1994 Bolongeat-Mobleu et al. .
5,347,097 9/1994 Bolongeat-Mobleu et al. .
5,350,892 9/1994 Rozier .
5,357,066 10/1994 Morel et al. .
5,357,068 10/1994 Rozier .
5,357,394 10/1994 Piney .
5,361,052 11/1994 Ferullo et al. .
5,373,130 12/1994 Barrault et al. .
5,379,013 1/1995 Coudert .
5,424,701 6/1995 Castonguary et al. .
5,438,176 8/1995 Bonnardel et al. .
5,440,088 8/1995 Coudert et al. .
5,449,871 9/1995 Batteux et al. .
5,450,048 9/1995 Leger et al. .
5,451,729 9/1995 Onderka et al. .
5,457,295 10/1995 Tanibe et al. .
5,467,069 11/1995 Payet-Burin et al. .
5,469,121 11/1995 Payet-Burin .
5,475,558 12/1995 Barjonnet et al. .
5,477,016 12/1995 Baginski et al. .
5,479,143 12/1995 Payet-Burin .
5,483,212 1/1996 Lankuttis et al. .
5,485,343 1/1996 Santos et al. .
5,493,083 2/1996 Olivier .
5,504,284 4/1996 Lazareth et al. .
5,504,290 4/1996 Baginski et al. .
5,510,761 4/1996 Boder et al. .
5,512,720 4/1996 Coudert et al. .
5,515,018 5/1996 DiMarco et al. .
5,519,361 5/1996 Mrenna et al. .
5,534,674 7/1996 Steffens .
5,534,832 7/1996 Duchemin et al. .

| | | |
|---|---|---|
| 5,534,835 | 7/1996 | McColloch et al. . |
| 5,534,840 | 7/1996 | Cuingnet . |
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER AUXILIARY MAGNETIC TRIP UNIT WITH PRESSURE SENSITIVE RELEASE

BACKGROUND OF THE INVENTION

The invention relates to circuit breakers with a magnetic trip unit, and, more particularly, to circuit breakers with a pressure sensitive magnetic trip release mechanism.

Circuit breakers typically provide protection against the very high currents produced by short circuits. This type of protection is provided in many circuit breakers by a magnetic trip unit, which trips the circuit breaker's operating mechanism to open the circuit breaker's main current carrying contacts upon a short circuit condition.

Modern magnetic trip units include a magnet yoke (anvil) disposed about a current carrying strap, an armature (lever) pivotally disposed proximate the anvil, and a spring arranged to bias the armature away from the magnet yoke. Upon the occurrence of a short circuit condition, very high currents pass through the strap. The increased current causes an increase in the magnetic field about the magnet yoke. The magnetic field acts to rapidly draw the armature towards the magnet yoke, against the bias of the spring. As the armature moves towards the yoke, the end of the armature contacts a trip lever, which is mechanically linked to the circuit breaker operating mechanism. Movement of the trip lever trips the operating mechanism, causing the main current-carrying contacts to open and stop the flow of electrical current to a protected circuit.

In all circuit breakers, the separation of the breaker contacts due to a short circuit causes an electrical arc to form between the separating contacts. The arc causes the formation of relatively high-pressure gases as well as ionization of air molecules within the circuit breaker. These high-pressure gases can cause damage to the circuit breaker casing. The gases, therefore, must be vented from the circuit breaker enclosure. In addition, a phase-to-phase fault can occur if the arc gases from different phases are allowed to mix, and a phase-to-ground fault (e.g. single phase fault) can occur if the gases contact the grounded enclosure. To avoid a phase-to-phase or phase-to-ground fault, gases vented from different phases must be kept separate from each other and away from the grounded enclosure until the ionization has dissipated.

An exhaust port is conventionally employed to vent such gasses in a rotary contact circuit breaker; each phase (pole) employs two pairs of contacts, two contacts of which rotate about a common axis generally perpendicular to the current path from the line side to the load side of the circuit breaker. Each contact set in such an arrangement requires an exhaust port to expel gasses. One of the exhaust ports will be on the line side and one of the exhaust ports will be on the load side of the circuit breaker. In conventional units, the exhaust port on the line side is located proximate the top of the circuit beaker. Since gasses naturally flow in the direction of this port on the line side of the breaker, the port is effective. On the load side of the circuit breaker, the gasses formed consequent to a short circuit naturally migrates toward the lower corner of the breaker. Thus, an exhaust port is located at this corner providing there is sufficient room to exhaust gasses from this port.

An electrical distribution system may contain a series of circuit breakers, namely upstream breakers and downstream breakers. When circuit breakers are connected in series, it is desirable to ensure that a given fault caused by a short circuit condition will trip the circuit breaker closest to the fault.

Such selectivity permits downstream breakers connected in series with an upstream breaker to trip without also tripping any upstream breakers. In this way, current to a room in a building can be shut off without shutting off current to the entire building. However, the upstream breaker must also be able to provide adequate protection for the circuit breaker when operating standalone in a non-selective application. If an upstream device trips at too low of a current threshold, there is no selectivity with any downstream breakers. If the upstream device trips at too high of a current threshold, there might not be adequate protection for the circuit breaker or its electrical system. Further, any tripping system must also ensure protection for the circuit breaker and the system in the event of a single-phase condition, e.g. only one phase becomes overloaded. In a multi-phase system, a single-phase condition exists when one pole experiences a fault thereby opening the contacts of that pole. The remaining poles do not experience the fault and therefore their respective contacts remain closed. A single-phase condition is not desirable in an application that uses a multi-phase component such as a three-phase motor. Therefore, it is desirable to provide a circuit breaker tripping system that will trip an upstream circuit breaker at a predefined short circuit fault level while ensuring protection of the circuit breaker and the electrical system should a single phase condition occur and, at the same time, avoiding unnecessary interruption of the performance of the circuit breaker.

SUMMARY OF THE INVENTION

In an exemplary embodiment of the present invention, an auxiliary magnetic trip unit is arranged on the load strap of an industrial-rated circuit breaker to interrupt circuit current upon occurrence of a high-level short circuit fault. The separation of the contacts upon a short circuit overcurrent condition creates pressurized gas that is vented from the circuit breaker. The magnetic trip unit employs a U-shaped magnet (magnet yoke) disposed about the load-side contact strap, an armature, a trip lever for interacting with a circuit breaker operating mechanism latch, and a lever arranged to restrain the armature from moving toward the magnet yoke and to release the armature in response to a predetermined level of pressurized gas. Thus providing an auxiliary magnetic trip unit for use with circuit breakers for selective short circuit overcurrent protection in an electrical distribution system with circuit breakers connected in series.

DESCRIPTION OF THE PREFERRED EMBODIMENT

Figure 1:
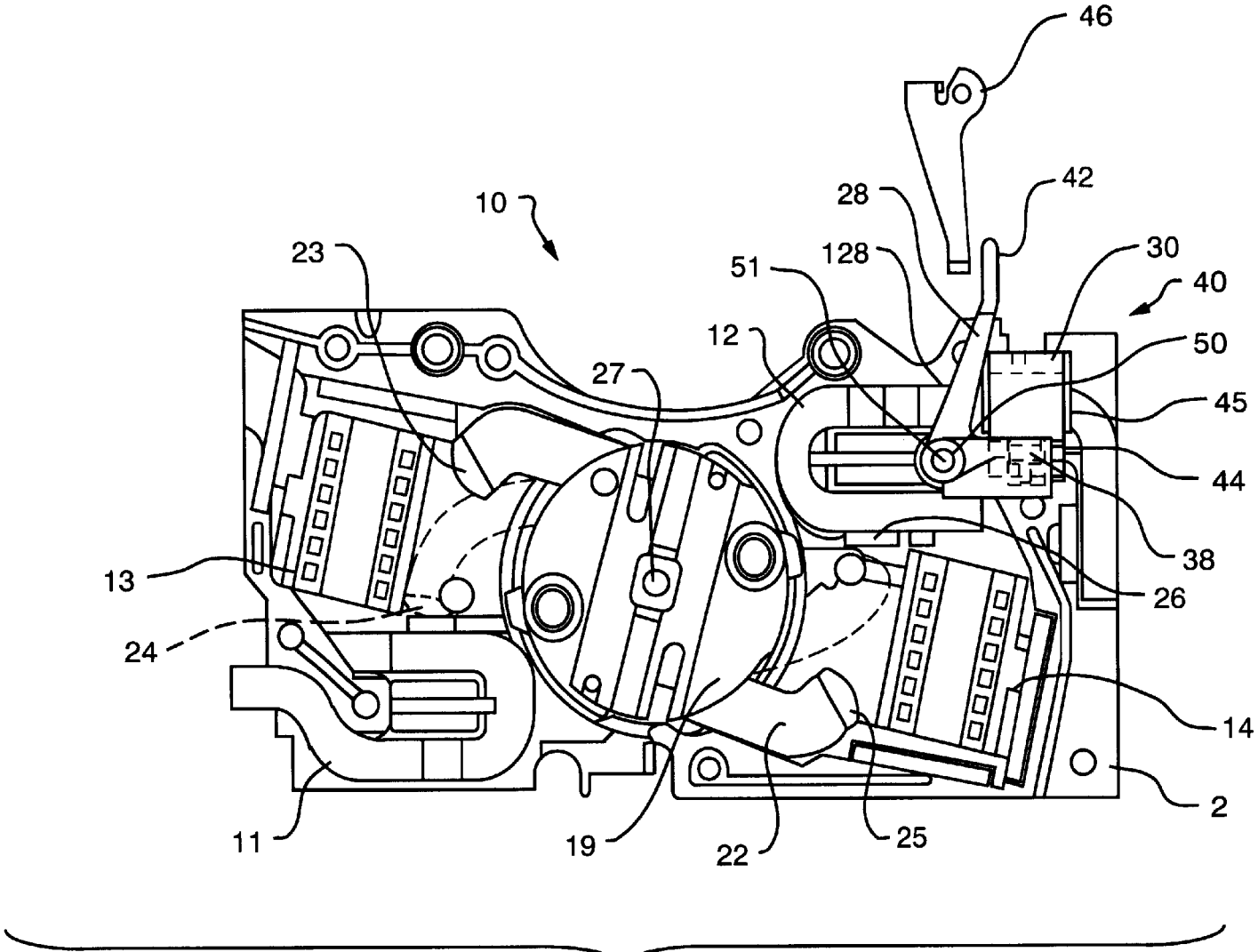
FIG. 1 is a side view of a circuit breaker cassette assembly of the type employing a rotary contact operating mechanism.

Referring to FIG. 1, a circuit breaker rotary contact assembly 10 is shown in an electrically insulative cassette half piece 2. Electrically insulative cassette half piece 2 is attached to a similar cassette half piece (not shown) to form a cassette. Opposing line-side and load-side contact straps 11, 12 are adapted for connection with an associated electrical distribution system and a protected electric circuit, respectively. Fixed contacts 24, 26 connect with the line-side and load-side contact straps, 11, 12 respectively, while the moveable contacts 23, 25 are attached to ends of a rotary contact arm 22 for making movable connection with the associated fixed contacts 24, 26 to allow electrical current to flow from the line-side contact strap 11 to the load-side contact strap 12.

The rotor 19 in the circuit breaker rotary contact assembly 10 is intermediate the line-side contact strap 11 and load-side contact strap 12 and associated arc chutes 13, 14. The arc chutes 13, 14 are similar to that described within U.S. Pat. No. 4,375,021 entitled RAPID ELECTRIC ARC EXTINGUISHING ASSEMBLY IN CIRCUIT BREAKER DEVICES SUCH AS ELECTRIC CIRCUIT BREAKERS. The moveable contact arm 22 is arranged between two halves of circular rotor 19. The moveable contact arm 22 includes first and second moveable contacts 25, 23 that are arranged opposite first and second fixed contacts 26, 24. The moveable contact arm 22 moves in unison with the rotor 19 that, in turn, connects with the circuit breaker operating mechanism (not shown) by means of an elongated pin (not shown) and linkage assembly (not shown) to move the movable contacts 23, 25 between the CLOSED position, depicted in dashed lines, and the OPEN position depicted in solid lines in FIG. 1. Upon a short circuit overcurrent condition, the contact pairs 23, 24, 25, 26 are separated. When the contact pairs 23, 24, 25, 26 are separated, electrical arcing occurs between the contact pairs 23, 24, 25, 26. These arcs are cooled and quenched within arc chutes 13, 14, thus preventing damage to the circuit breaker 10.

A magnet assembly 40 is attached to the load end of the circuit breaker 10 by positioning a magnet yoke 30 on a top surface 12B of load-side contact strap 12. The cassette enclosure insulates the top portion of magnet assembly 40. An insulator 45 envelops the underside and sides of the magnet yoke 30 thereby preventing the magnet yoke 30 and the load-side contact strap 12 from making contact. Further, the insulator 45 is attached to the top surface 12B of the load-side contact strap 12 by two molded pins (not shown). The molded pins extend outward from the underside surface of the insulator 45 and extend through corresponding openings (not shown) in the load-side contact strap 12. The magnet yoke 30 is thus positioned proximate to the load-side contact strap 12.

A latch mechanism (latch) 46 is mounted such that it pivots on an axis positioned in the circuit breaker operating mechanism (not shown). A trip lever 28 has a first end 42 located proximate to the latch 46 and a second end 44 positioned near magnet assembly 40. Upon a high-level short circuit condition, armature 38 is attracted to the magnet yoke 30 due to the magnetic field created around the magnet yoke 30. This attraction causes the armature 38 to make contact with second end 44 of trip lever 28. Trip lever 28 then rotates in a counterclockwise direction causing the first end 42 of the trip lever 28 to make contact with latch 46. Latch 46 activates the circuit breaker operating mechanism (not shown) that causes the moveable contacts 23, 25 to separate from the fixed contacts 24, 26. In other words, movement of latch 46 by trip lever 28 causes the circuit breaker to trip. The construction and operation of the circuit breaker operating mechanism is known in the art.

Trip lever 28 is pivotally mounted to an external face of the cassette half-piece (not shown) opposite cassette half-piece 2. The trip lever 28 includes a first molded pin 50 extending radially outward from the trip lever along axis 51 and inserted through an opening (not shown) in the cassette half-piece (not shown) opposite cassette half-piece 2. Also, the trip lever 28 rotates about the first molded pin 50. It should be noted that if trip lever 28 is to be used with a second pole of the circuit breaker, then the trip lever 28 also includes a second molded pin 50 extending radially outward from trip lever 28, opposite to the first molded pin. The second molded pin 50 is inserted through a corresponding opening in an outer cassette half piece for that respective pole.

Figure 2:
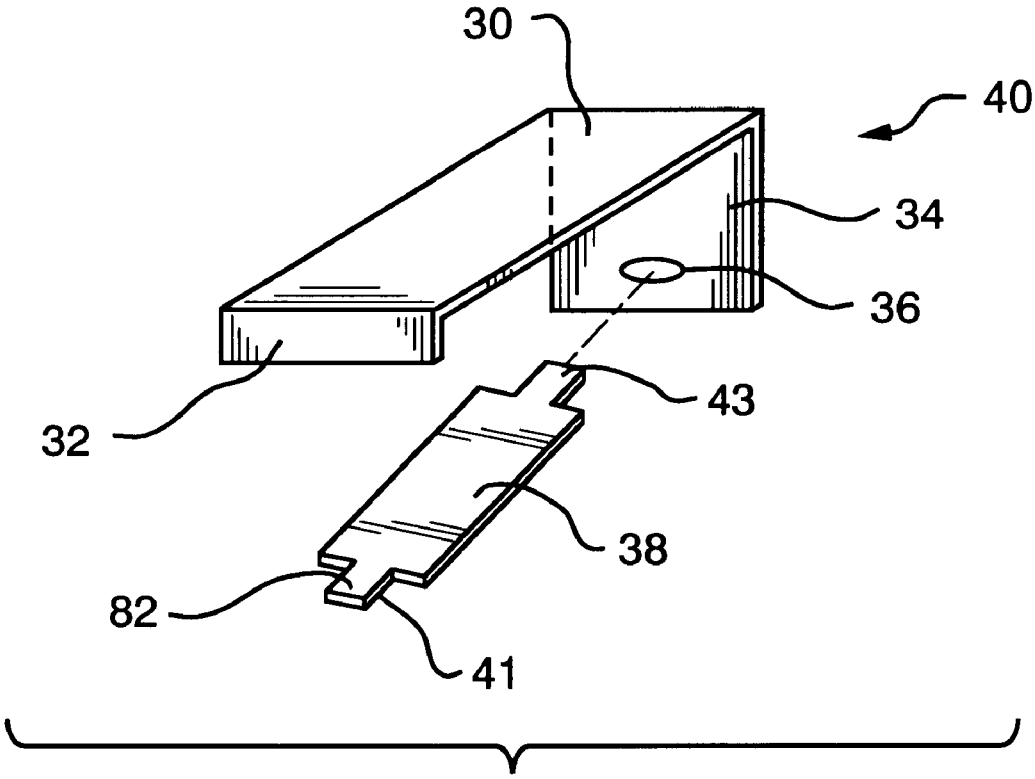
FIG. 2 is an isometric view of the magnet assembly.

Referring to FIG. 2, the magnet assembly 40 is shown in more detail. Magnet yoke 30 includes a first side arm 32 and a second side arm 34 containing an armature slot 36. An armature 38 is positioned onto the magnet yoke 30 by insertion of a pivot arm 43, shaped on one end of the armature 38, within the armature slot 36. An actuator arm 41, shaped on the opposite end of the armature 38 extends beyond the sidearm 32. Armature arm 41 has a top surface 82. Actuator arm 41 extends through the cassette half-piece (not shown), and is located proximate the second end 44 of trip lever 28 (FIG. 1).

Figure 3:
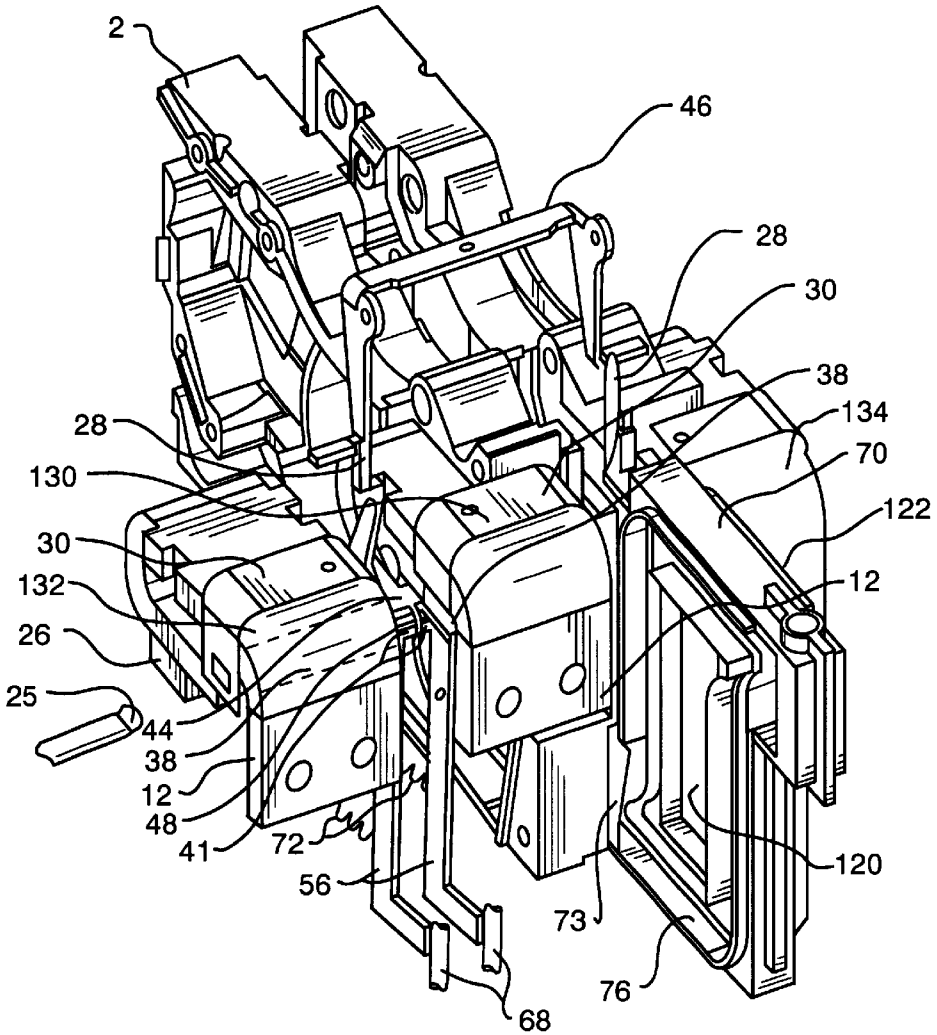
FIG. 3 is a perspective view of the circuit breaker assembly of FIG. 1.

Referring to FIG. 3, a vent structure 70 is shown assembled to the outer surface of cassette half piece 2 for a three-phase system. Vent structure 70 is connected to the cassette half-piece 2 by means of a connector member 73. Vent structure 70 includes a first side 120 and a second side 122. First side 120 includes a depressed, bifurcated path 76.

A trip lever 28 is shown positioned between two cassettes. Second end 44 of trip lever 28 includes an outwardly extending fin 48. Actuator arm 41 of the first pole 130 is proximate to second end 44; an actuator arm (41) of the second pole 132 is also proximate to second end 44. Fin 48 separates actuator arm 41 of the first pole 130 and actuator arm (not shown) of the second pole 132. Consequently, in a three-phase system, an actuator arm (not shown) of a third pole 134 would operate a second trip lever 28. Latch 46 operates in conjunction with each trip lever 28. In this way, during a short circuit condition in any phase (pole) of the electrical distribution system, the respective trip lever 28 will activate the latch 46 causing all phases in the circuit breaker to open. This avoids a single-phase condition where the contacts of only one phase of a multi-phase system would open while the contacts 25, 26 of the remaining poles remain closed. A magnet block lever (lever) 56 and spring 72 for the first pole 130 are shown and will be discussed in reference to FIG. 5.

Figure 4:
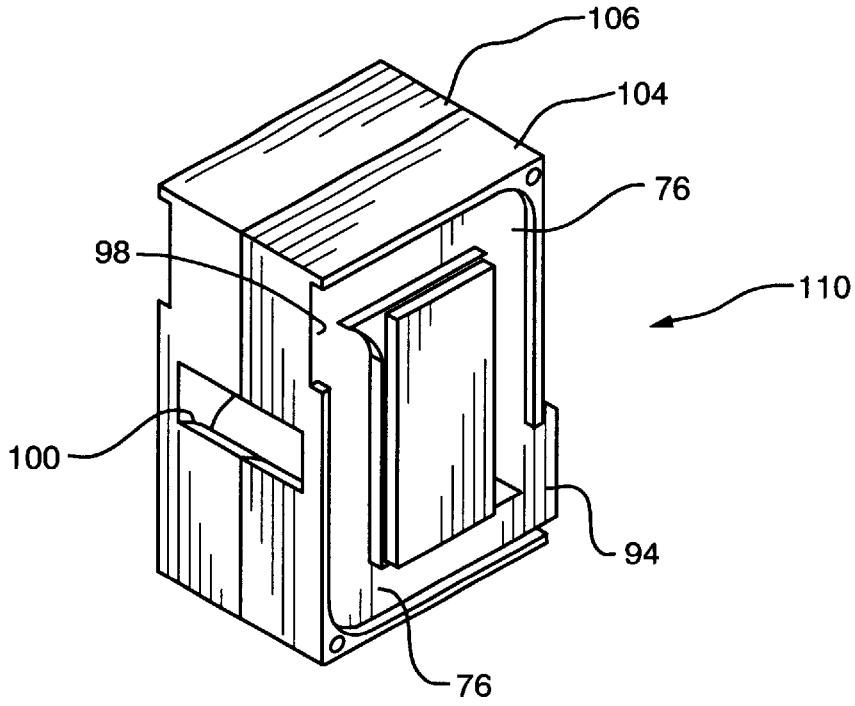
FIG. 4 is an isometric projection of the vent housing.

Referring to FIGS. 3 and 4, where FIG. 4 shows a vent housing 110 including a first half 104 and a second half 106. External to first half 104 is a depressed, bifurcated path 76. Vent structure 70 is assembled with the vent housing 110 by joining the first half 104 of the vent housing 110 with the first side 120 of vent structure 70. Upon assembly, bifurcated path 76 of the vent housing 110 mates with bifurcated path 76 of the vent structure to form an enclosed load gas passage 76. Upon assembly of the vent structure 70 with the vent housing 110, an inlet 94 and an outlet 98 are also formed. Arc gases, upon exiting a cassette, enter the inlet 94 and are released into the load gas passage 76. The arc gases finally exit the circuit breaker through outlet 98.

Vent housing 110 houses a commercially available current transformer (not shown) for providing power to electronic components within the circuit breaker, as is known in the art. An opening 100 is formed by first and second sides 104, 106 of vent housing 110. Opening 100 permits through passage of a load-side strap extender (not shown) for connection with the load-side contact strap 12 (FIG. 1).

The vent housing 110 and the vent structure 70 are similar to the type described in U.S. patent application Ser. No.

09/225,988 entitled CIRCUIT BREAKER VENTING ARRANGEMENT, filed Jan. 5, 1999, which is incorporated herein by reference.

Figure 5:
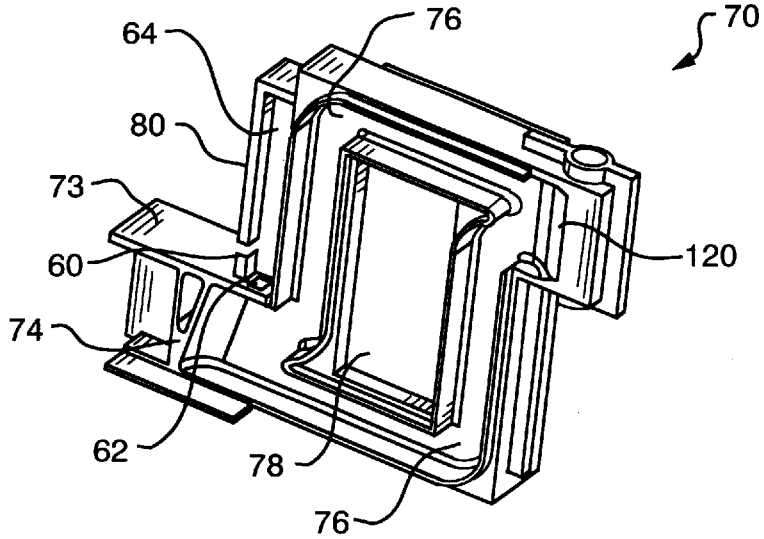
FIG. 5 is a side perspective view of the vent structure.

Referring to FIG. 5, first side 120 of vent structure 70 is shown in more detail. Vent structure 70 includes an opening 62 in connector member 73. A chamber 64 is formed within the vent structure 70 when the connector member 73 is attached to the cassette half piece 2 (FIG. 3). Opening 62 is in fluid communication with the chamber 64 and the load gas passage 76. Thus, opening 62 is a passageway for arc gases to enter the chamber 64 from the load gas passage 76. Chamber 64 has an exterior wall 80 that is proximate to the connector member 73. Chamber 64 also includes an opening 60 in exterior wall 80. Each cassette in a multi-pole circuit breaker includes a separate chamber 64.

It should be noted that in order to accommodate multi-phases within a circuit breaker, vent structure 70 is preferably located on each side of vent housing 110. Therefore, if vent structure 70 is employed between two vent housings 110, the above-discussed features will be located on both sides of vent structure 70. If vent structure 70 is employed on the last vent housing 110 of a multi-pole circuit breaker, the above-discussed features will be located on only one side of vent structure 70.

Figure 6:
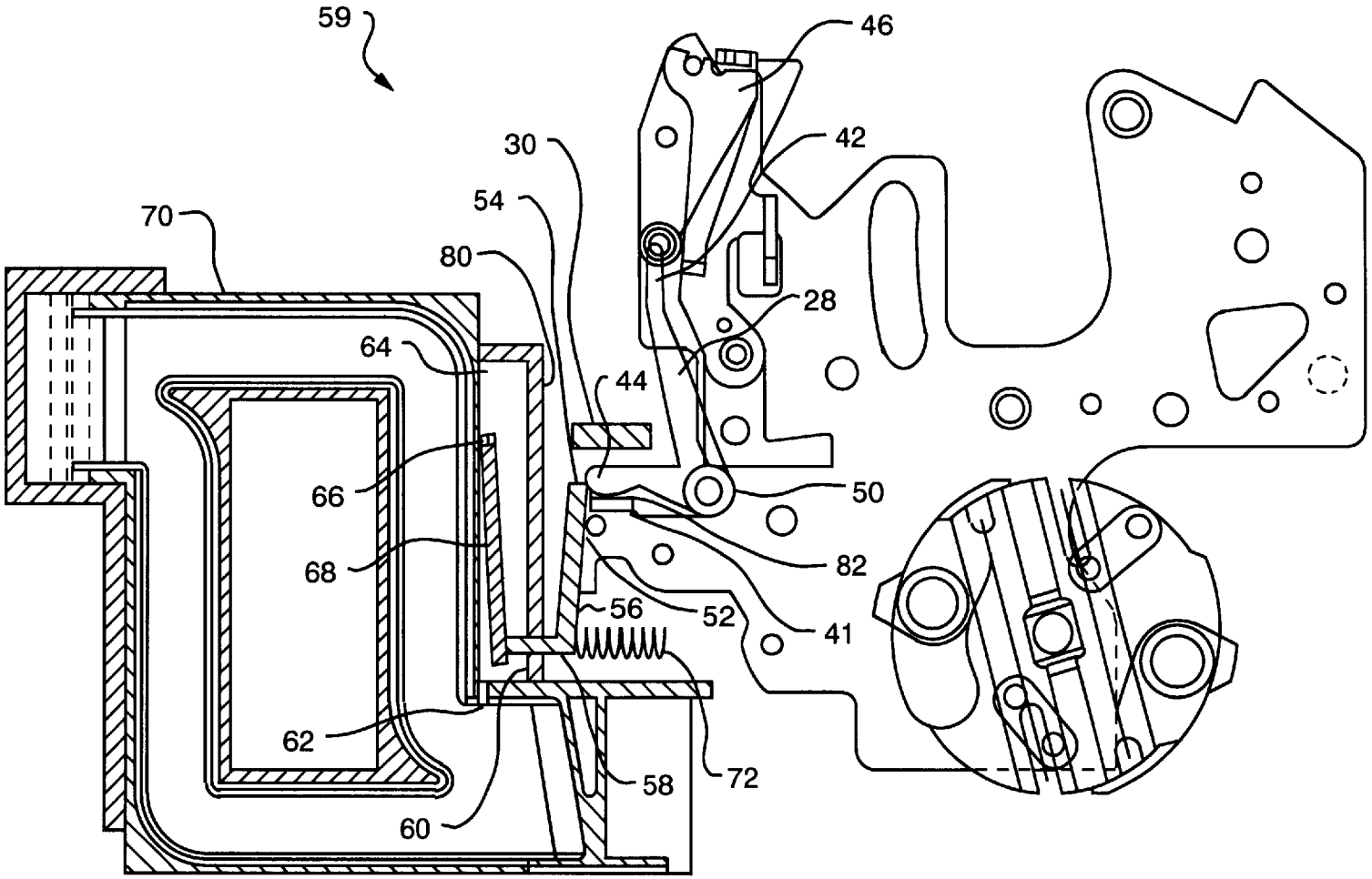
FIG. 6 is an illustration of the pressure sensitive magnetic trip release mechanism.

Referring to FIG. 6, a pressure sensitive magnetic trip release mechanism 59 (magnetic trip unit) is shown. Magnet block lever 56 includes a first arm 54 and a second arm 58. The magnet block lever 56 rotates about a pivot 52 located proximate to the first arm 54. Pivot 52 is located on the exterior of cassette half-piece (not shown) which mates with cassette half-piece 2 (FIG. 3). The first arm 54 is positioned over the top surface 82 of the actuator arm 41 thereby preventing movement of the actuator arm 41 towards the magnet yoke 30. The second arm 58 extends through opening 60 of the vent structure 70 and into chamber 64. A link 68 is located within chamber 64. Link 68 is pivotally mounted at one end to a pin 66. At the opposite end, link 68 slidable contacts second arm 58. Spring 72 has a moveable end attached to lever 56 and a fixed end attached externally to the cassette half-piece (not shown) which mates with cassette half-piece 2 (FIG. 3). Spring 72 biases the first arm 54 of the magnet block lever 56 over the top surface 82 of the actuator arm 41.

Although the pressure sensitive magnetic trip release mechanism 59 is shown in FIG. 6 for a single pole 130, it is understood that a separate pressure sensitive trip lever mechanism including a magnet yoke 30, actuator arm 41, magnet block lever 56, and link 68 can be arranged for each pole in a circuit breaker housing having a plurality of poles 132, 134.

Referring to FIGS. 1, 2, 3, 4, 5 and 6, a circuit breaker with a pressure sensitive magnetic trip release mechanism 59 operates as follows. Under high-level short circuit faults, the contact arm 22 is opened due to the magnetic forces at the stationary and moveable contacts 24, 26, 23, 25. As the contact arm 22 is opened and the moveable contacts 23, 25 are separated from the stationary contacts 24, 26, a plasma arc is formed between the stationary and moveable contacts 24, 26, 23, 25. This arc generates arc gases of relatively high pressure that exit the arc chute 14 and enter into load gas passage 76 from inlet 94. The pressurized gas enters the chamber 64 via opening 62. The increased high level of current being carried through load-side contact strap 12 also induces a magnetic field around the magnet yoke 30.

To the extent that when a specific current is exceeded, the magnetic force generated by the magnet yoke 30 is sufficient to attract the armature 38. However, due to the positioning of the magnet block lever 56, the actuator arm 41 is not permitted to move toward the magnet yoke 30.

Generally, the level of pressure created in the chamber 64 is proportional to the level of the short circuit fault. Therefore, once the pressure inside the chamber 64 reaches a predetermined level that is consistent with the desired short circuit overcurrent level for which a trip of the circuit breaker is desired, link 68 rotates counter-clockwise about pin 66 in response to the increased pressure within chamber 64. The movement of link 68 causes the magnet block lever 56 to rotate counter-clockwise about pivot 52. Thus, first arm 54 is no longer positioned over the top surface 82 of the actuator arm 41. Once actuator arm 41 is released, the armature 38 is permitted to move vertically upward toward the magnet yoke 30. The armature 38 moves in response to the magnetic field around the magnet yoke 30 caused by the overcurrent condition. The actuator arm 41 then makes contact with second end 44 of the trip lever 28. The trip lever 28 rotates clockwise about pin 50 thereby unlatching the latch 46 causing all phases of the circuit breaker to trip in response to the short circuit condition.

The pressure sensitive magnetic trip release mechanism 59 can be arranged for use in a circuit breaker having a plurality of cassettes. Each pole or phase or the circuit breaker utilizes a pressure sensitive magnetic trip release mechanism 59 which interacts with the corresponding chamber 64 of the corresponding side of the vent structure 70. When a high level short circuit occurs, the most loaded pole will trip due to the pressure increase in chamber 64. Therefore, since each pole employs a pressure sensitive magnetic trip release mechanism 59, a trip of one pole causes all poles of the circuit breaker to open. Thus, a single-phase condition is prevented.

Further, when circuit breakers are in series, for example, an upstream circuit breaker in series with a downstream circuit breaker, the pressure sensitive magnetic trip release mechanism 59 permits selectivity between two circuit breakers of different ratings having the same short circuit current flowing through them. Selectivity ensures that the circuit breaker closest to the fault will trip. Under low overcurrent conditions, it is desirable to selectively not permit an upstream circuit breaker to trip thereby permitting the downstream breaker to trip. Selectivity is also needed when a fault in the electrical distribution system occurs closest to a downstream circuit breaker. For example, if a larger magnet yoke 30 cannot be utilized in an upstream circuit breaker to prevent saturation at too low of an overcurrent, then the movement of the armature 38 must be prevented until a predetermined high-level short circuit occurs. At such a predetermined high level short circuit condition, the movement of the armature must be released so that the selected circuit breaker can trip.

Since the level of pressure in the chamber 64 is proportional to the fault current, the sensitivity of the pressure sensitive magnetic trip release mechanism 59 in each cassette can be adjusted independently to any desired level. This adjustment can be achieved by changing the size or location of the opening 62, the size or shape of the magnet block lever 56, or by changing the force generated by the spring 72. In this case, the pressure sensitivity of the trip blocking mechanism utilized in an upstream circuit breaker is set at a lower level than downstream breakers thereby preventing the upstream breaker from tripping under lower current short circuit conditions in the electrical distribution system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

an electrically insulative cassette halfpiece;

a first electrically conductive strap arranged within said electrically insulative cassette halfpiece;

a first fixed contact electrically connected to said first electrically conductive strap and a first moveable contact arranged opposite said first fixed contact, said first movable contact arranged to separate from said first fixed contact upon an overcurrent condition, the separation of said first movable contact from said first fixed contact forms an arc between said first fixed contact and said first movable contact creating pressurized gas;

a latching mechanism configured to separate said first pair of electrical contacts;

a first magnet yoke, said first magnet yoke superposes said first electrically conductive strap;

a first armature pivotally disposed proximate to said first magnet yoke, said first armature arranged to move in a direction towards said first magnet yoke upon the overcurrent condition;

a first lever arranged to restrain said first armature from moving in a direction toward said first magnet yoke during the overcurrent condition, said lever in response to a predetermined level of the pressurized gas, releases said first armature to move towards said first magnet yoke thereby urging said first armature to interact with said latching mechanism;

said first magnet yoke includes first and second side arms, said second side arm having a slot and said first armature having a pivot arm at one end thereof and an actuator arm at an opposite end thereof, said pivot arm being partially captured within said slot, said first armature pivots about said pivot arm; and wherein said first lever includes:

a first arm and a second arm extending from a common pivot, said first arm restrains said first armature from moving in a direction towards said first magnet yoke; and further including first link pivotally mounted at one end thereof and at an opposite end attached to said second arm of said first lever, said link in fluid communication with the pressurized gas, said first link rotates said first lever in response to the predetermined level of pressurized gas.

2. The circuit breaker of claim 1 further including a trip lever configured to interact with the latching mechanism, said trip lever being arranged proximate to said first armature.

3. The circuit breaker of claim 2 wherein said trip lever having first and second ends extending from a common pivot, said first end located proximate to the latching mechanism and said second end is arranged to restrain said first armature from moving toward said first magnet yoke during an overcurrent condition;

wherein said first link, in response to the predetermined level of pressurized gas, rotates said first lever to release said restraint on said first armature thereby urging said first armature to interact with said second end of said trip lever thereby urging said first end of said trip lever to unlatch the latching mechanism.

4. The circuit breaker of claim 3, further including:

a second electrically conductive strap arranged within said electrically insulative cassette halfpiece; a second fixed contact electrically connected to said second electrically conductive strap and a second moveable contact arranged opposite said second fixed contact, said second movable contact arranged to separate from said second fixed contact upon an overcurrent condition, the separation of said second movable contact from said second fixed contact forms an arc between said second fixed contact and said second movable contact creating pressurized gas;

a second magnet yoke, said second magnet yoke superposes said second electrically conductive strap;

a second armature pivotally disposed proximate to said second magnet yoke, said second armature arranged to move in a direction towards said second magnet yoke upon the overcurrent condition, wherein said trip lever being arranged proximate to said second armature; and a second lever arranged to restrain said second armature from moving in a direction toward said second magnet yoke during the overcurrent condition, said second lever in response to a predetermined level of the pressurized gas, releases said second armature to move towards said second magnet yoke thereby urging said second armature to interact with said latching mechanism.

5. The circuit breaker of claim 4, further including:

a second spring having fixed and moveable ends, said moveable end being attached to said second lever, said second spring biases said second lever to restrain said second armature.

6. The circuit breaker of claim 4 wherein said second magnet yoke includes first and second side arms, said second side arm having a slot at one end thereof and said second armature having a pivot arm at one end thereof and an actuator arm at an opposite end thereof, said pivot arm being partially captured within said slot, said second armature pivots about said pivot arm of said second armature.

7. The circuit breaker of claim 6 wherein said second lever includes:

a first arm and a second arm extending from a common pivot, said second arm restrains said second armature from moving in a direction toward said second magnet yoke;

and further including a second link pivotally mounted at one end thereof and at an opposite end attached to said second arm of said second lever, said second link in fluid communication with the pressurized gas, said second link rotates said second lever in response to the predetermined level of pressurized gas.

8. The circuit breaker of claim 1 further including:

an electrically insulative cassette half-piece;

a load gas passage beneath said first electrically conductive strap;

a vent structure matable to said electrically insulative cassette half-piece with an exhaust gas inlet in fluid communication with said load gas passage; and a chamber formed when said vent structure mates with said electrically insulative cassette half-piece, said chamber having a first opening and a second opening, wherein said first lever extends through said first opening, said second opening permitting pressurized gas into said chamber, wherein said first link is pivotally mounted inside said chamber and arranged to rotate said first lever about a pivot to release said first armature in response to the predetermined level of pressurized gas in said chamber.

9. The circuit breaker of claim 1 wherein said first arm of said first lever releasably engages said first armature and is positioned between said first armature and said first magnet yoke.

10. The circuit breaker of claim 2 wherein said trip lever includes a pin extending from said common pivot, said pin inserted into an opening within said electrically insulative cassette half piece.

11. The circuit breaker of claim 7 wherein said second end of said trip lever is arranged to restrain said second armature from moving toward said second magnet yoke during an overcurrent condition;

wherein said second link, in response to the predetermined level of pressurized gas, rotates said second lever to release said restraint on said second armature thereby urging said second armature to interact with said second end of said trip lever thereby urging said first end of said trip lever to unlatch the latching mechanism.

12. The circuit breaker of claim 11 wherein said second end of said trip lever is includes a fin, said fin positioned between said actuator arm of said first armature and said actuator arm of said second armature.

* * * * *